US009555955B2

(12) United States Patent
Wurtzel et al.

(10) Patent No.: US 9,555,955 B2
(45) **Date of Patent: *Jan. 31, 2017**

(54) PACKAGE ASSEMBLY

(75) Inventors: Jeff Wurtzel, Chicago, IL (US); Lindsey Talaga, Wilmette, IL (US); Melinda Lewis, Chicago, IL (US); Victor Mehren, Geneva, IL (US)

(73) Assignee: WM. WRIGLEY JR. COMPANY, Chicago, IL (US)

( * ) Notice: Subject to any disclaimer, the term of this patent is extended or adjusted under 35 U.S.C. 154(b) by 134 days.

This patent is subject to a terminal disclaimer.

(21) Appl. No.: 13/634,601

(22) PCT Filed: Mar. 15, 2010

(86) PCT No.: PCT/US2010/027339

§ 371 (c)(1),
(2), (4) Date: May 16, 2013

(87) PCT Pub. No.: WO2010/060120

PCT Pub. Date: May 27, 2010

(65) Prior Publication Data

US 2013/0220861 A1 Aug. 29, 2013

(51) Int. Cl.

| | |
|---|---|
| ***B65D 85/60*** | (2006.01) |
| ***B65D 25/36*** | (2006.01) |
| ***B65D 5/62*** | (2006.01) |

(52) U.S. Cl.

CPC ..... *B65D 85/60* (2013.01); *B65D 5/62* (2013.01); *B65D 25/36* (2013.01); *B65D 2203/00* (2013.01)

(58) Field of Classification Search

CPC ..... B65D 5/62; B65D 25/36; B65D 85/60; B65D 2203/00

USPC ..... 206/457, 459.1, 459.5, 497, 800; 229/87.07, 87.08

See application file for complete search history.

(56) References Cited

U.S. PATENT DOCUMENTS

| | | | | |
|---|---|---|---|---|
| 2,433,663 | A * | 12/1947 | Hanson | 206/459.5 |
| 2,559,000 | A * | 7/1951 | Back | 206/459.5 |
| 6,024,219 | A | 2/2000 | Froehlich et al. | |
| 7,686,165 | B2 * | 3/2010 | Aldridge et al. | 206/449 |
| 7,913,846 | B2 * | 3/2011 | Aldridge et al. | 206/449 |
| 7,971,718 | B2 * | 7/2011 | Aldridge | 229/87.07 |
| 8,172,086 | B2 * | 5/2012 | Aldridge et al. | 206/449 |
| 2003/0080015 | A1 * | 5/2003 | Kopecky | 206/459.5 |
| 2003/0168363 | A1 * | 9/2003 | Molitor | 206/315.9 |
| 2008/0142392 | A1 | 6/2008 | Aldridge | |

(Continued)

FOREIGN PATENT DOCUMENTS

| | | |
|---|---|---|
| CA | 2099940 | 1/1994 |
| CA | 2168783 | 2/1995 |

(Continued)

OTHER PUBLICATIONS

International Search Report corresponding to International Patent Application No. PCT/US2010/027339 mailed Nov. 3, 2010.

(Continued)

*Primary Examiner* — Luan K Bui

(57) ABSTRACT

A package assembly (10) includes a package (14) having a body defining a receptacle for receiving a confectionery product, an outer surface for displaying a non-verbal design, and a removable overwrap (12) disposed about the body of the package, wherein the overwrap (12) is substantially opaque and includes verbal product information.

6 Claims, 6 Drawing Sheets

(56) References Cited

U.S. PATENT DOCUMENTS

| | | | | |
|---|---|---|---|---|
| 2008/0173564 | A1 | 7/2008 | Aldridge | |
| 2008/0277295 | A1* | 11/2008 | Benson et al. | 206/459.5 |
| 2009/0032576 | A1* | 2/2009 | Kugel | 229/164.1 |
| 2011/0162997 | A1* | 7/2011 | Robbins et al. | 206/746 |
| 2012/0043246 | A1* | 2/2012 | Kidwell et al. | 206/459.5 |

FOREIGN PATENT DOCUMENTS

| | | |
|---|---|---|
| CN | 2085358 | 9/1991 |
| CN | 2851169 | 12/2006 |
| CN | 1968857 | 5/2007 |
| CN | 201305173 | 9/2009 |
| WO | 2008/153954 | 12/2008 |

OTHER PUBLICATIONS

Search Report corresponding to CN Patent Application No. 201080066773X mailed Apr. 14, 2014.
Canadian Intellectual Property Office, Official Action in U.S. Pat. No. 2,793,269, dated Jan. 31, 2014. (2 pages).

* cited by examiner

PACKAGE ASSEMBLY

TECHNICAL FIELD

The disclosure relates to a package assembly for use with a consumable product, such as a confectionery product. More specifically, the disclosure is directed to an assembly including a package displaying a non-verbal design and an overwrap including verbal product information.

BACKGROUND OF THE INVENTION

Customers purchase and use consumable goods, in particular confectionary products, for a number of different reasons. While for the most part confectionary products (e.g., chewing gum, candy, mints) are purchased based on the consumer's interest in the product, such as for example, taste, texture, flavor, or any other added benefits, there are other instances when the customer's point of purchase interest is triggered by the packaging of the product. The packaging of a product suggests a lot about a product and conveys a message to the consumer before the product is even open or used. The marketing of a product may create or enhance a customer's initial impression of the product or the image that the customer associates with the product. As with many consumer packaged goods, the packaging of the product provides insight into the product's identification, while at the same time serving a functional purpose of protecting the product from the environment.

In general, current packages for confectionary products identify the product and provide consumers with product information. Packaging is traditionally used to identify the brand of the product and provide additional information to the consumer, such as flavor, piece count, ingredient and allergen information, manufacturer contact information, and any other type of information relevant to the consumer's purchase, some of which is required by law or regulation. This type of product information is traditionally in the form of words (i.e., verbal communication). This form of communication is traditionally printed directly on the packaging so that the information is maintained on the package even when a protective film (e.g., overwrap) is removed by the consumer.

Confectionery products, in particular chewing gum, may be carried by a consumer either in a purse, backpack, briefcase, or any other bag readily available or accessible to the consumer throughout their day. For the consumers, gum packaging is an accessory that may not only be carried within a bag, but within a pocket or in the consumer's hand for continued use. As a result, gum packaging serves as a medium and is at the center of social situations. The type of gum a person uses may further convey a message about that individual's likes, dislikes, and/or personality. Accordingly, there is a need to have a package that consumers want to carry with them. Moreover, there is a need to have a package that is recognizable by the consumer on a product shelf (i.e., readily identifiable), but that may further enhance the consumer experience after purchase.

SUMMARY OF THE INVENTION

A package assembly including a package having a body defining a receptacle for receiving a confectionery product, an outer surface for displaying a non-verbal design, and a removable overwrap disposed about the body of the package, wherein the overwrap is substantially opaque and includes verbal product information.

BRIEF DESCRIPTION OF THE DRAWINGS

The present invention will now be described by way of example, with reference to the accompanying drawings.

DETAILED DESCRIPTION OF THE INVENTION

The present disclosure provides a package assembly for use with a consumable product. In one embodiment, the package assembly is used in combination with confectionary products, such as for example, chewing gum. The package assembly includes a package and an overwrap. In one embodiment, the package of the assembly includes a body defining a receptacle for receiving a confectionery product, and an outer surface for displaying a non-verbal design. The non-verbal design, for example, may include, but is not limited to, an image or graphic. The assembly may further provide a removable overwrap which is disposed about the body of the package. The overwrap may be substantially opaque and includes verbal product information. Although the Figures and related disclosure are directed to packaging for confectionary products, in particular chewing gum, the present invention may be directed to various applications, including but not limited to consumable products, alternate confectionary products such as mints, candy (including hard, chewy or gummy candy), chocolate and/or any other confectionary. Accordingly, the Figures are exemplary and illustrate various aspects of the present disclosure.

As suggested, one embodiment of a packaging assembly 10, as illustrated in the Figures, may be configured for use with chewing gum. The chewing gum may be provided in various forms, such as for example, tab, stick or pellet form. For illustrative purposes, the embodiments as presented in the provided Figures are directed to embodiments using chewing gum in tab form. Various aspects of the present invention may be modified to accommodate alternate forms of chewing gum.

Figure 1:
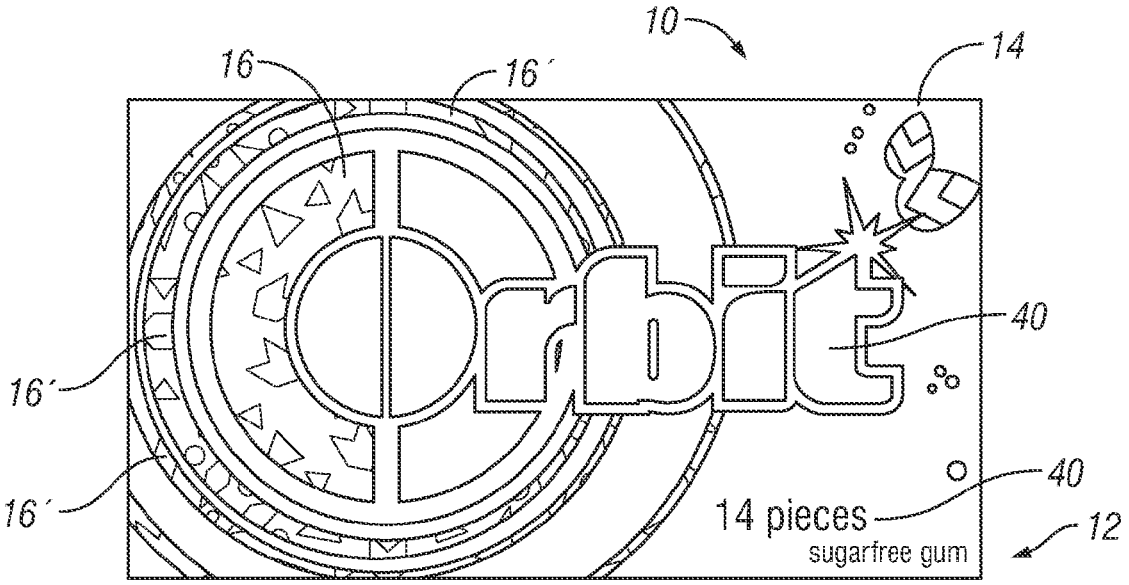
FIG. 1 is a perspective view of a package assembly in accordance with an embodiment of the present invention.
Figure 2:
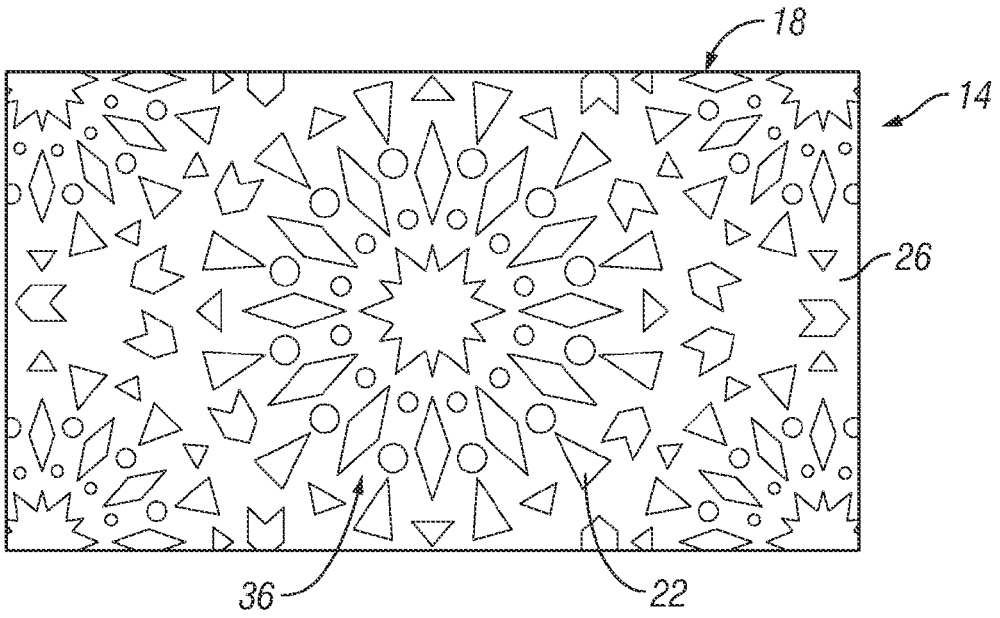
FIG. 2 is a perspective of a package in accordance with an embodiment of the invention.

In one aspect, the package assembly 10 includes an overwrap 12 that is disposed over and encloses a package 14, such as illustrated for example in FIGS. 1 and 2. The overwrap may be designed to convey the product information to the consumer while at the same time, attracting the consumer to the product on the store shelf. Moreover, the overwrap is designed to seal the confectionary product from the outside environment and preserve the product qualities (i.e., taste, flavor, and chew quality). Accordingly, the overwrap 12 may be comprised of a plastic or plastic-like material and/or film used to enclose package 14. In general, the overwrap is removable from the package. In one aspect, the overwrap must be torn or penetrated to access the enclosed package 14.

In accordance with another aspect of the invention, the overwrap 12 may include verbal production information 40 that reflects the identification of the confectionary product contained within the package 14. In general, "verbal" is used herein to mean any information conveyed in word(s), letter(s), number(s), or any combinations thereof, in any language or communication form. Moreover, the term "verbal product information" is herein used to mean information such as ingredients, packaging information (i.e., piece count), brand information, product information (i.e., flavor), manufacturer contact information, and any other information that is used to identify the confectionary information or used for salability of the confectionary product. The use of this information on the overwrap 12 further conveys an informative message to the consumer while representing the image of the brand.

In another aspect, the overwrap 12 may be opaque or at least substantially opaque. "Opaque" is herein used to mean that the overwrap is not clear. Accordingly, "substantially opaque" is herein used to mean at least approximately 70 to 95 percent of the overwrap is not clear. As a result, in one embodiment, the overwrap does not allow for the consumer to see the outer surface of the package 14 that is disposed beneath the overwrap 12. In another embodiment, the overwrap may be opaque but made of such a material that although the consumer may not readily see the underlying package, the design may be somewhat visible through the overwrap. In another embodiment, a viewing portion (i.e., window) 16 may be provided within the overwrap. The viewing portion 16 of the overwrap may be clear, thereby allowing a portion of the outer surface of the package 14 to be visible through the overwrap 12. In one embodiment, the viewing portion 16 may be clear. Alternatively, it is recognized that the viewing portion 16 may be substantially translucent but may further include a color or pattern to enhance the appearance of the overwrap 12. In one embodiment, the viewing portion 16 may have a semi-circular shape. Additional viewing portions, such as 16' may be included within the overwrap, such as for example, in a ring-like pattern, semi-circular or circular configurations, or alternate designs that provided discrete viewing portions through the overwrap 12. The viewing portion may comprise approximately 5 to 30 percent of the overwrap. Alternate configurations and related embodiments of overwrap 12 are further shown in FIGS. 3*a*, 4*a*, 6, and 7*a*. Each of the provided Figures exemplify alternate configurations of the overwrap 12.

Figure 3A:
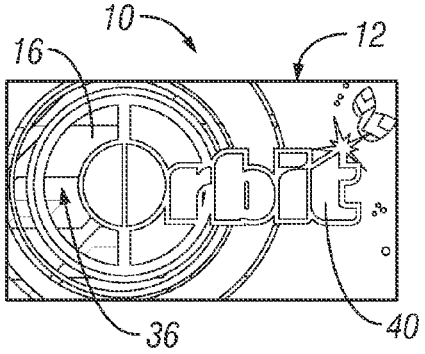
FIGS. 3A-3D are alternate views of the package assembly and components of the assembly in accordance with an embodiment of the invention.
Figure 3B:
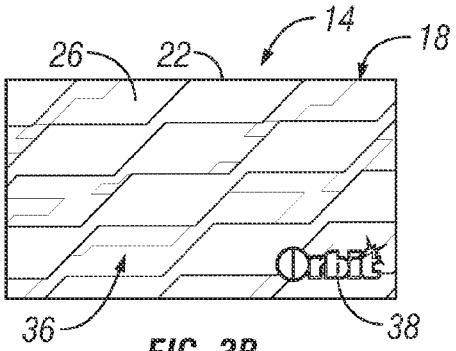
Figure 3C:
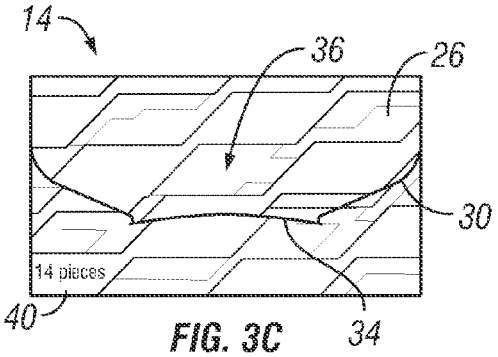
Figure 3D:
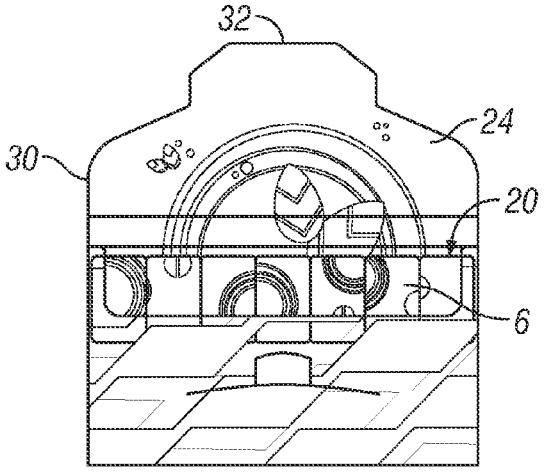
Figure 4A:
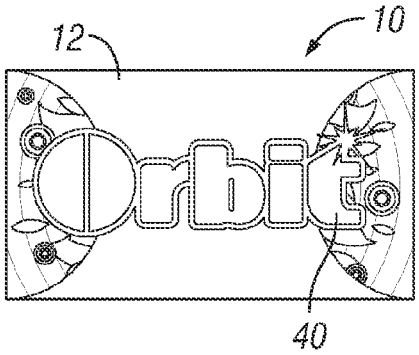
FIGS. 4A-4D are alternate views of the package assembly and components of the assembly in accordance with an embodiment of the invention.
Figure 4B:
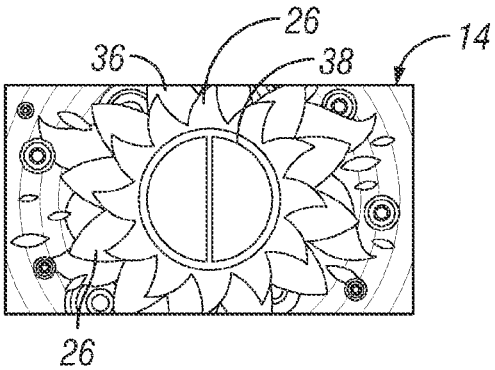
Figure 4C:
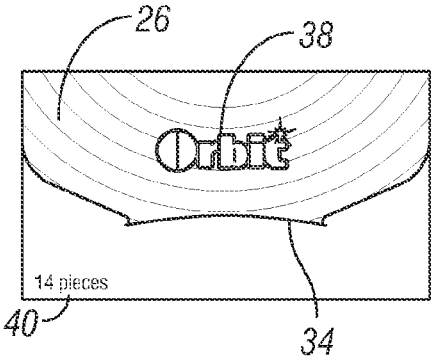
Figure 4D:
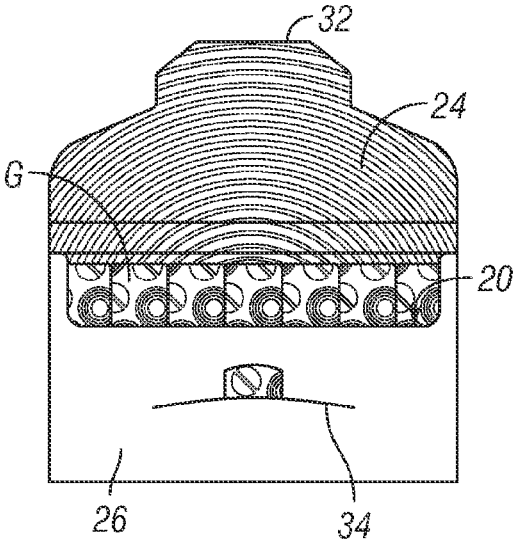

In accordance with one aspect of the invention, the package 14 of assembly 10 includes a body 18 that defines and forms the package 14, as illustrated, for example, in FIG. 2, as well as FIGS. 3B-3D and 4B-4D. Body 18 further defines a receptacle 20 (as shown in FIGS. 3D and 4D) for receiving and holding a confectionary product, such as for example, chewing gum G. Moreover, the body 18 of package 14 further provides an outer surface 22. The outer surface 22 is visible to the consumer upon removing the overwrap 12. As a result, the outer surface 22 is the portion of the package 14 that conveys a visual message to the consumer and others during continued use of the confectionary.

Overall, the body 18 of the package 14 may be comprised of various materials. In one embodiment, the body 18 is made of paperboard. In another embodiment, the body 18 may be made of cardboard or an alternate paper based product, either single or multi-layered. Alternatively, body 18 may be formed from all types of materials used in the packaging of confections, including for example, but not limited to paper, composites, plastic, foil, or any other type of packaging product that is identified as being useful in the packaging of confectionary products. Although the present disclosure shows the package 14 in a substantially rectangular-like configuration, the package 14 may further be provided in various configurations, including but not limited to, alternate shapes and sizes. Traditionally, the package 14 has a known rectangular shaped dimension that is traditionally used in the packaging of chewing gum. The package may have a predefined length, width and height, such that the three dimensional container is uniform in dimensions. Alternatively, body 18 may be formed in various shapes and may include a number of dimensions depending on the need of the container and the overall package size. Moreover, body 18 may be reconfigured depending on the type of gum form used in connection with the package 14.

The receptacle 20 is defined by the body 18 of package 14. The receptacle 20 may be any suitable size or shape that is defined by the package 14, including but not limited to, rectangular or cubic. The receptacle 20 defines an opening which enables the confectionary products G to be removed from the receptacle. As suggested, the receptacle 20 may further be configured in various sizes to accommodate different types of gum form, such as tab, stick or pellet, as well as various piece counts. As a result, the present disclosure recognizes that alternate configurations and sizes of the receptacle may be contemplated and used depending on the design of the package assembly 10.

As previously suggested, the outer surface 22 is the portion and/or surface of the package 14 that is visible once the overwrap 12 is removed. As further shown in FIGS. 3*d* and 4*d*, body 18 of package 14 further includes an inner surface 24. The inner surface 24 of body 18 aids in the formation of the receptacle 20 for the chewing gum G. The inner surface 24 of body 18 is not visible until package 14 is opened by the consumer to access the confectionary product G through the opening of the package 14.

Figure 5:
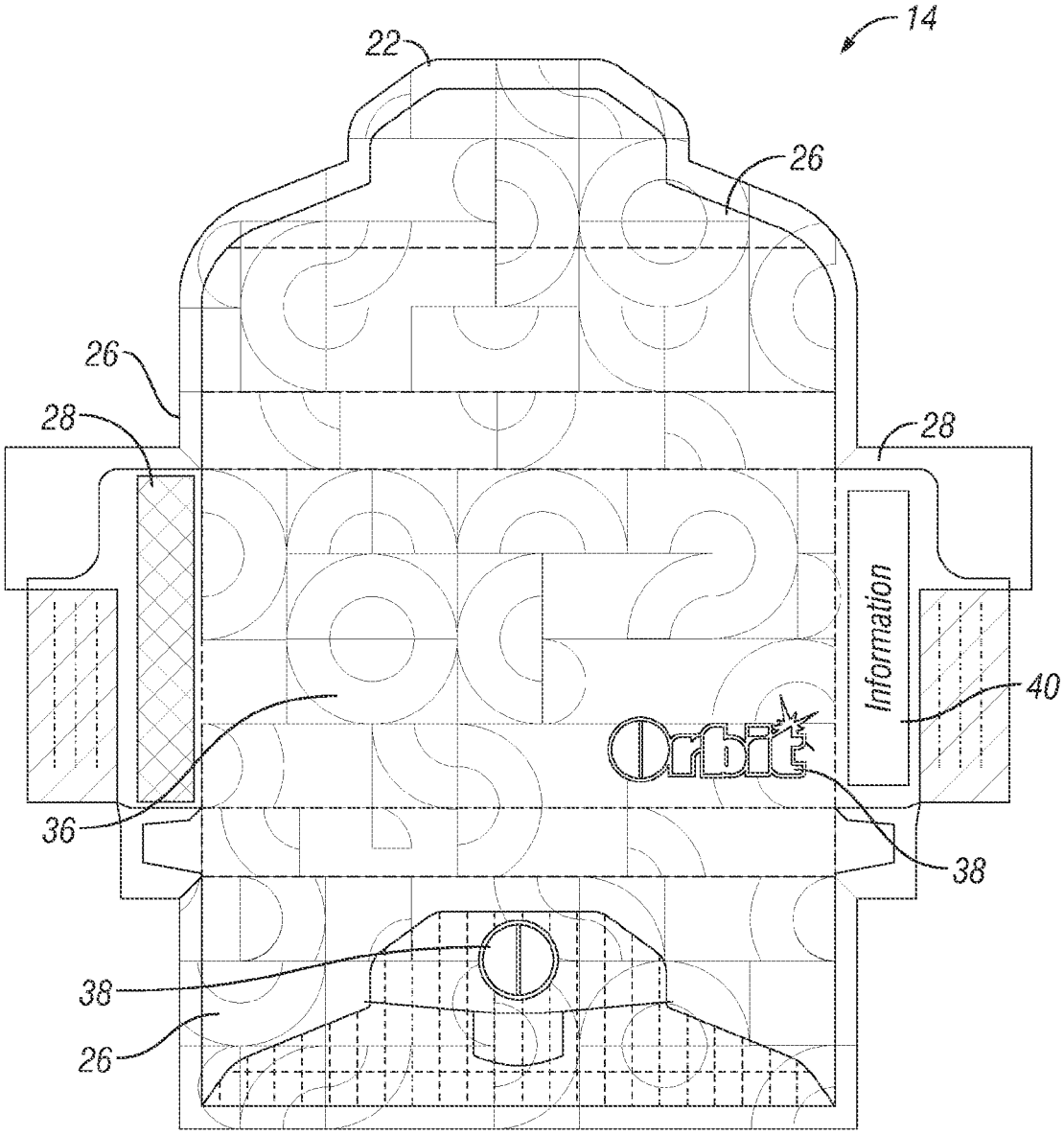
FIG. 5 is a view of a package prior to assembly in accordance with an embodiment of the invention.

The outer surface 22 may be further comprised of a number of surfaces that define body 18. In one particular embodiment, the outer surface 22 includes at least two primary surfaces 26, which are readily apparent through the Figures. Moreover, a plurality of secondary surfaces 28, as shown in FIG. 5, form a smaller portion of the outer surface 22 upon the formation of the package 14 once assembled. In one embodiment, primary surfaces 26 may provide the largest surface areas visible to the consumer. Primary surfaces 26 may further define the front and back of the package 14 (as shown in FIGS. 3B-3D and 4B-4D). One primary surface 26 may further include an access panel 30 for accessing the confectionary G within the receptacle 20 of the package 14. A securing member 32, such as a tab, may further be provided for enclosing the back of the package once a confectionary product is removed. The securing member 32 may be secured through connection with a slot 34 or other type of coupling member. The secondary surfaces 28 may further define the sides (i.e., perimeter) of the package 14 and connect the primary surfaces 26 to each other once the package, as shown in FIG. 5, is configured for packaging purposes.

In accordance with an embodiment of the present disclosure, the outer surface 22 of package 14 further includes a non-verbal design 36. "Non-verbal design" as herein used means a design comprised of patterns, shapes, colors, images or combinations thereof to display an overall stylized surface. In particular, the non-verbal design further allows for a customer to express one's own personality and style through the use of packaging. In an embodiment, the non-verbal design 36 may include a combination of similar colors provided in various patterns, including but not limited to, swirls, diamonds, cubes, circles, rectangles, parallelograms, or any other shapes that provide an overall stylized impression to the consumer. In general, the non-verbal design does not include the use of alpha and/or numeric components. Various non-verbal designs, as illustrated by FIGS. 1-5 and 7, may be used on the outer surface 22 of package 14 to provide a stylized accessory containing confectionary products.

Although the outer surface 22 includes an overall non-verbal design, other alternate embodiments may include alpha and/or numeric components within the non-verbal design, such that the components are not visibly perceivable by the consumer (i.e., to the consumers naked eye). Accordingly, the alpha/numeric components may be provided in such a combination to form an overall design and/or image. For example, any alpha/numeric components or combinations thereof may be so small in scale that individually they are not visibly recognizable by the consumer, but instead the overall combination forms an image or design visually recognizable by the consumer.

In general, the non-verbal design 36 may be provided on the outer surface 22 of package 14 to serve as a fashionable accessory and/or enhance the customer's experience with the package once the customer removes the overwrap 12 from the package assembly 10. In an embodiment, the non-verbal design may substantially cover the entire outer surface 22 of the package 16, such that the user only sees the non-verbal design when looking at the outer surface 22 of the package. In another embodiment, the non-verbal design may be provided on approximately 60 to approximately 98 percent of the outer surface 22 of the package 16. Alternatively, the non-verbal design may be provided on approximately 85 percent to approximately 98 percent of the outer surface 22 of package 14. Overall, the non-verbal design is provided on a substantial portion of the outer surface 22 of the package 14 thereby providing an overall visual impression.

In another embodiment, the non-verbal design may be provided on the primary surfaces 24 of the outer surface 22. Accordingly, the non-verbal design 36 may substantially cover the primary surfaces 24 of the package 14. In an embodiment, the non-verbal design may be provided on approximately 60 to approximately 100 percent of the primary surfaces 24 of the package 16. Alternatively, the non-verbal design may be provided on approximately 85 percent to approximately 98 percent of the primary surfaces of package 16. Although alternate ranges may be contemplated by the present disclosure, it is desirable to maintain the overall visual appearance of the outer surface 22 of the package 14 with a non-verbal design.

In addition to the non-verbal design 36 on the outer surface 22 of package 14, a brand identifier 38 may further be provided on the outer surface 22. "Brand identifier" as herein used means a trademark, logo, words, trade features and/or any other product identification information, or combinations thereof that are each individually or in combination with one another recognizable by a consumer and used in the identification of a brand. For illustrative purposes, one particular example of a brand identifier, includes but is not limited to, the trademark Orbit®, as shown for example in FIG. 3B, or the logo associated with the Orbit® brand, as shown for example, in FIG. 4B. Such brand identifiers 38 may be positioned on the outer surface 22 of package 14, so that they are recognizable by the consumer, but do no effect the overall non-verbal design on the outer surface 22 of the package 14. Although the provided Figures are directed to specific brand identifiers related to Orbit®, the invention as disclosed is in no way limited to the use of specific brand identifiers and may include any type of brand identifier used in the identification of products, in particular, confectionary products.

In an embodiment of the present invention, the brand identifier 38 may be limited in size, orientation, and/or position on the outer surface 22 of the package 14. Accordingly, the brand identifier 38 may be provided in a designated position, such as for example, a corner of the outer surface or a primary surface, as shown in FIG. 3*b*. Moreover, brand identifier 38 may be limited in size. For example, the brand identifier 38 may comprise approximately 2 to approximately 35 percent of the outer surface 22 of the package 14. Alternatively, brand identifier 38 may be provided on a secondary surface 28 of the outer surface 22, such that the primary surfaces 26 are substantially covered by the non-verbal design.

In one embodiment, further verbal product information 40, such as for example, regulatory information may be provided on a secondary surface 28 of the outer surface 22 of the package. As shown in FIG. 5, the verbal product information 40 is necessary for the consumer to have access to information such as ingredients, allergen information, product contact information, or any other type of information necessary to the consumer that must remain with the package 14, instead of removable through the use of the overwrap 12. As a result it is necessary to provide limited verbal product information on the outer surface 22 of the package 14, without compromising the overall visual effect of the non-verbal design 36 provided on the package.

Figure 6:
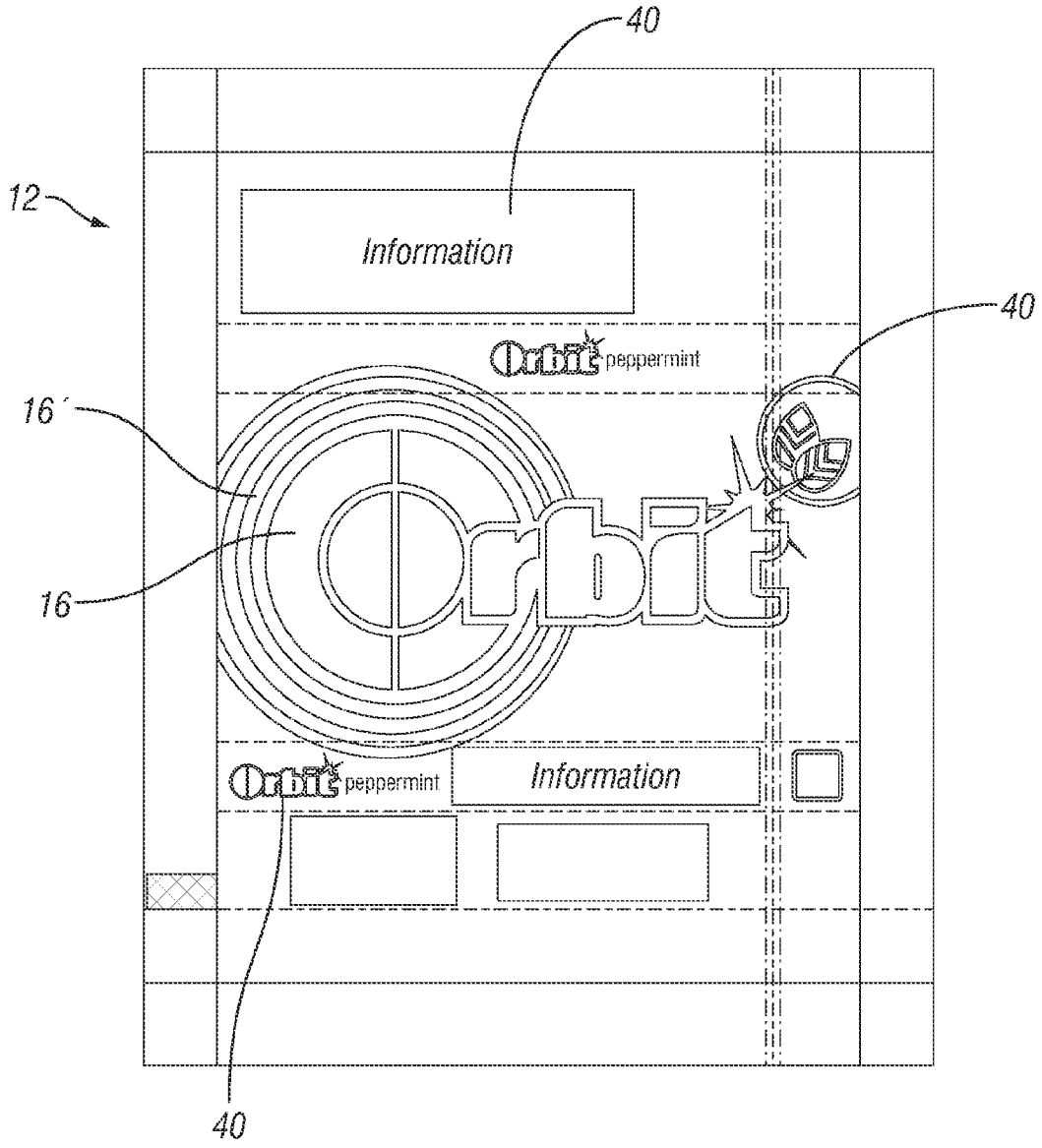
FIG. 6 is a perspective view of an overwrap prior to assembly in accordance with an embodiment of the invention.

Although limited verbal product information is provided on the package 12 itself, overwrap 12 is primarily responsible for providing verbal product identification information to the consumer. As previously suggested, overwrap 12 primarily attracts the consumer at the point of purchase and conveys the product and corresponding brand information to the consumer, while at the same time providing dietary and ingredient information, such as illustrated in FIG. 6. Overall, the verbal product information provided on the overwrap is primarily used to identify the confectionary product during the initial sale of the confectionary product. Accordingly, overwrap 12 is different than the design of the package 14. More specifically, the visual style and layout of the overwrap 12 is different than the non-verbal design on the package 14. It is through the combination of the overwrap 12 and package 14 that allows for consumer recognition, while at the same time meeting the needs of the customers for a stylized and unique package.

During consumer testing, consumers associated the package assembly of the present invention with desirable attributes and/or qualities (e.g., interesting, leader, youthful, popular, attractive and friendly/likable). Moreover, consumers identified the package assembly of the present invention as an "innovative package", as well as representative of a "premium brand" in comparison to traditional packages. In general, the present invention provides an enhanced experience to consumers compared to current packages. Customer testing demonstrates that the customers clearly recognized the improvement of the package assembly in contrast to traditional packages. For example, during testing, approximately 77 percent of consumers tested identified the package assembly of the present invention as having"package uniqueness" in comparison to 29 percent based on the current package. Moreover, consumer testing further suggested a significant increase in the consumer's intent to purchase the package assembly of the present invention in comparison to current package designs. Accordingly, consumers identified the package assembly of the present invention as an innovative package that would enhance their experience and increase their motivation to purchase the product.

Figure 7A:
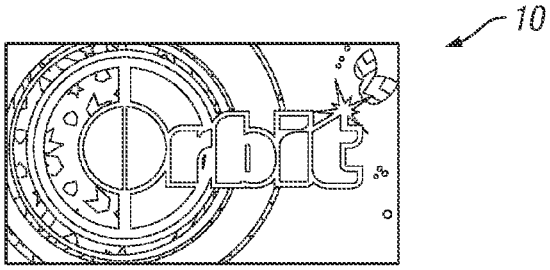
FIGS. 7A-7D are alternate views of the package assembly in accordance with an embodiment of the invention.
Figure 7B:
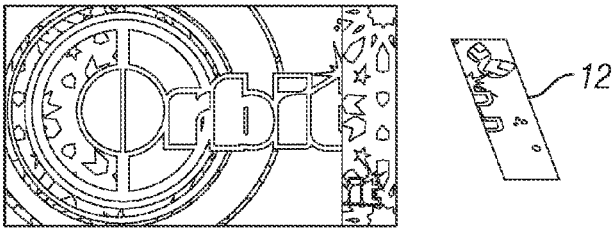
Figure 7C:
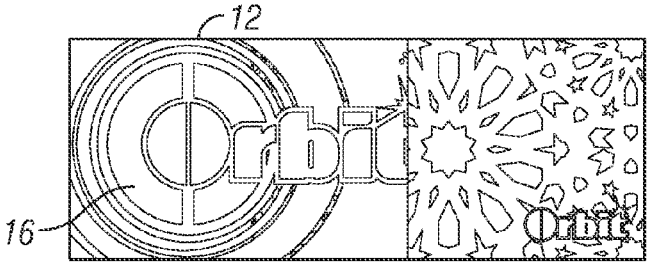
Figure 7D:
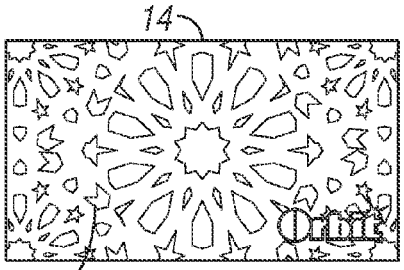

The present invention further provides a method for selling confectionary products. In accordance with one aspect, the method includes providing a package assembly. As previously disclosed, the assembly visually apparent at the store or alternate point of purchase includes the package assembly 10 having the overwrap 12 enclosing package 14, as illustrated for example in FIG. 7A. The customer may remove the overwrap 14, as demonstrated in FIGS. 7B and 7C, such that the non-verbal design 36 on package 14 is visually apparent. Upon the removal of the overwrap 12, the package 14 may then function as an accessory containing a confectionary product (as shown in FIG. 7D).

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

The invention claimed is:

1. A confectionary product package assembly, the assembly comprising:

a package including a unitary body defining a receptacle for receiving a plurality of confectionery products, the body providing an outer surface said outer surface comprising a non-verbal design; and a removable overwrap disposed about the body of the package, wherein the overwrap is substantially opaque and includes verbal product information said overwrap comprising a translucent viewing portion for displaying a portion of the outer surface of the package and said overwrap does not include a pictorial representation of a true picture of the products contained in the package.

2. The package assembly of claim 1, wherein said non-verbal design comprises approximately 80 percent to 95 percent of the outer surface of the package.

3. The package assembly of claim 1, wherein said non-verbal design further comprises colors, patters, shapes, images, and combinations thereof.

4. The package assembly of claim 1, wherein said overwrap further includes a style and layout that is different than the non-verbal design on the package.

5. The package assembly of claim 1, wherein said viewing portion comprises approximately 5 percent to approximately 30% of said overwrap.

6. The package assembly of claim 1, wherein approximately 70 percent to 95 percent of said overwrap is substantially opaque.

* * * * *